United States Patent [19]

Bost

[11] Patent Number: 4,767,010

[45] Date of Patent: Aug. 30, 1988

[54] BEARING SORTING DEVICE

[76] Inventor: John R. Bost, P.O. Box 902, Laurens, S.C. 29360

[21] Appl. No.: 914,288

[22] Filed: Oct. 2, 1986

[51] Int. Cl.[4] ..... B01C 5/06

[52] U.S. Cl. ..... 209/670; 209/673; 384/535

[58] Field of Search ..... 209/667, 668, 670, 673; 384/535, 581; 464/52, 57, 183, 117, 88

[56] References Cited

U.S. PATENT DOCUMENTS

| | | | |
|---|---|---|---|
| 1,498,144 | 6/1924 | Avery | 209/667 |
| 1,647,816 | 11/1927 | Riddell | 209/668 |
| 2,425,478 | 8/1947 | Lawton et al. | 209/668 |
| 3,108,691 | 10/1963 | Vance | 209/670 |
| 3,238,808 | 3/1966 | Barnard | 464/52 |
| 3,848,741 | 11/1974 | Haley et al. | 209/668 |
| 3,905,208 | 9/1975 | Oyama et al. | 464/88 |
| 4,172,527 | 10/1979 | Bost | 209/668 |

FOREIGN PATENT DOCUMENTS

| | | | |
|---|---|---|---|
| 415242 | 10/1946 | Italy | 209/673 |

*Primary Examiner*—Robert B. Reeves
*Assistant Examiner*—Donald T. Hajec
*Attorney, Agent, or Firm*—Dority & Manning

[57] ABSTRACT

An apparatus for sorting round bearings which include a pair of elongated cylinders that are rotatably supported so that the longitudinal axes thereof diverge, defining a sorting gap between the surface of the cylinders. The cylinders are supported on an inclined plane and are connected to a drive means by means of a flexible driving member for rotating the cylinders in opposite directions. The bearings which are to be sorted are fed onto the cylinders and moved down the inclined plane, down the sorting gap until the width of the sorting gap is sufficient to permit the bearings to drop through the gap into preselected receptacles.

20 Claims, 3 Drawing Sheets

BEARING SORTING DEVICE

BACKGROUND OF THE INVENTION

In the past, in sorting bearings such as needle bearings, ball bearings or roller bearings, they were allowed to slide down between rotating cylinders whose axes were mounted in a diverging manner so as to provide a gradually enlarging sorting gap between the cylinders. As the bearings slid down the cylinders, they would drop through the gap at the point where the width of the gap exceeded the diameter of the bearings. If it had been possible to make the sorting cylinders perfectly cylindrical, they could be driven while still maintaining the desired sorting gap. However, it is substantially impossible to make a perfectly cylindrical roll and, accordingly, while the variances may not be noticeable to the human eye, when sorting bearings to high tolerances such as ten millionths of an inch, any variance in the diameter of the cylinders causes changes in the width of the sorting gap.

In U.S. Pat. No. 4,172,527, applicant has patented a bearing sorting device which will reliably sort round bearings to tolerances of ten millionths of an inch. In the apparatus disclosed in this patent, a pair of elongated cylinders are rotatably and floatingly supported so that the longitudinal axes of the cylinders diverge, forming a sorting gap between the surfaces of the cylinders. The cylinders are carried on an incline with a drive connected to one end of each of the cylinders for rotating the cylinders in opposite directions. The lower end of the cylinders are connected by timing gears while positively synchronizing the rotation of the cylinders relative to each other so that the same points on the cylinders appear at the sorting gap on each revolution of the cylinders. The bearings which are sorted are fed onto the cylinders at the upper end and moved down the sorting gap until the width of the sorting gap is sufficient to permit the bearings to drop through into predetermined receptacles. The device shown and illustrated in this patent works quite well to sort bearings within ten millionths of an inch. However, it has been found that where the sorting cylinders are driven through a direct driven pulley mechanism, the forces imparted by the driving belt cause a radial deflection of the elongated sorting rolls themselves which causes the sorting gap between the cylinders to vary. Such deflection affects the accuracy of the sorting of the bearings. Looking at FIG. 2 of U.S. Pat. No. 4,172,527, if the drive belts for driving the pulley were perfect, there would be no problem. However, it has been determined that there are always variances in the thicknesses of the drive belts and that this variance in the thickness of the drive belts causes a variance in radial stresses applied to the axle of the sorting cylinders, and to the cylinders themselves as they are rotating.

SUMMARY OF THE INVENTION

This invention includes an apparatus for sorting round bearings such as needle bearings according to their diameters. The invention includes a pair of elongated cylinders which are rotatably and floatingly supported so that their longitudinal axes diverge, forming a sorting gap between the surfaces of the cylinders which increases from one end to the other. The cylinders are supported on an inclined plane so that the cylinders slope downwardly from one end to the other.

A drive for driving the sorting cylinders comprises a drive pulley for each of the cylinders fixed to a drive shaft for rotation therewith. In turn, the drive shafts are connected to the supporting shaft for each of the sorting cylinders by means of flexible couplings. The use of the flexible couplings assures that any distortions or radial stresses imparted to the drive pulleys by variations in the drive belts are not imparted to the supporting shafts of the sorting cylinders. By thus eliminating the effect of radial stresses on the sorting cylinders, the bearing sorting apparatus of the invention can sort bearings to a tolerance of approximately five millionths of an inch.

Accordingly, it is an important object of the present invention to provide an apparatus for sorting round bearings to a very high degree of sorting precision.

Another important object of the present invention is to provide an apparatus which sorts bearings at a high rate and to a high degree of tolerances which is not susceptible to radial stresses in the drive system.

Still another important object of the present invention is to provide a simple and efficient device for sorting bearings to a very high degree of tolerance with a minimum amount of supervision.

These and other objects and advantages of the invention would become apparent upon reference to the following specification, attendant claims and the drawings.

DETAILED DESCRIPTION OF THE INVENTION

Figure 1:
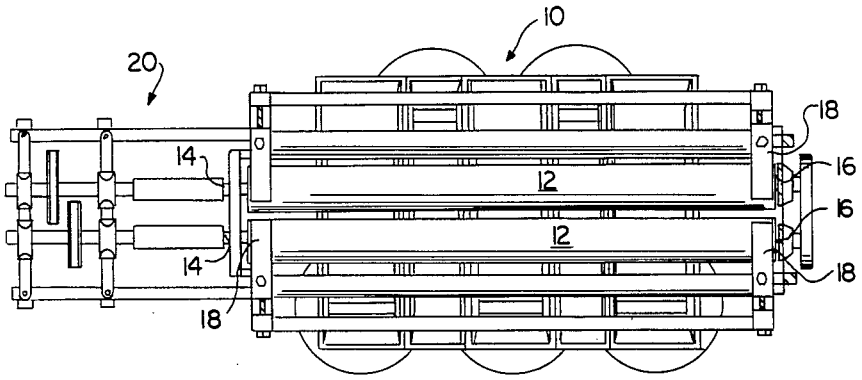
FIG. 1 is a top plan view, illustrating a bearing sorting device constructed in accordance with the present invention.

Referring in more detail to FIG. 1 of the drawings, wherein is illustrated an apparatus for sorting round bearings such as needle bearings, ball bearings, roller bearings, and the like.

The sorting apparatus 10 includes a pair of sorting cylinders 12 which are supported on cylinder supporting shafts 14 which, in turn, are supported by a series of floating bearings 16 for rotation about their longitudinal axes. The sorting cylinders 12 are mounted so as to form a sorting gap between cylinders 12 with the gap being narrower at the upper or drive end and gradually widening as it approaches the lower end. Furthermore, the upper or guide end is supported slightly higher than the lower end so that the bearings will move downwardly through the gap between the sorting cylinders 12. A plurality of space blocks 18, in conjunction with bearings 16, permit the gap between cylinders 12 to be adjusted. Details of the supporting of sorting cylinders 12 will be found in my U.S. Pat. No. 4,172,527, which issued Oct. 30, 1979. This patent shows details of the bearings and the support of the space blocks for adjusting the spacing of the sorting cylinders which, per se, do not form a part of the present invention.

Figure 2:
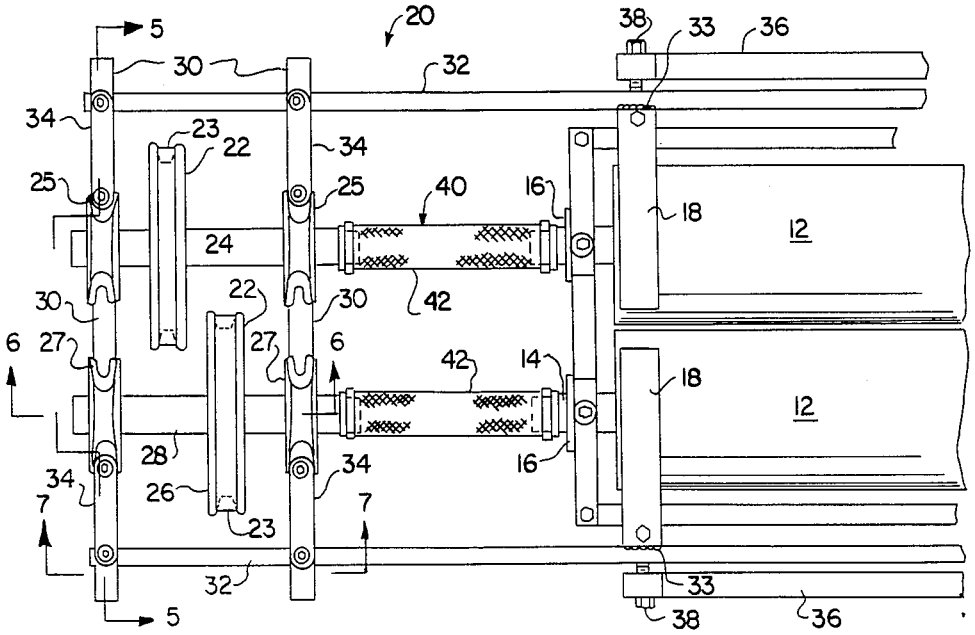
FIG. 2 is an enlarged top plan view of the drive end of the sorting device illustrated in FIG. 1.

Referring more particularly to FIG. 2 wherein a drive mechanism 20 for driving or rotating sorting cylinders 12 is disclosed. For one of cylinders 12, there is provided a drive pulley 22 which is supported on a pulley shaft in floating bearings 25. A second drive pulley 26 is provided for the other cylinder 12 and drive pulley 26 is mounted on a second pulley shaft 28. Shaft 28 is rotatably supported in floating bearing blocks 27.

Bearing 25 and 27 are slidingly supported by bearing support rails 30, which permits the bearings for each of the pulley shafts to move transversely of their longitudinal axes where needed to relieve stresses in the drive.

Extending along each side of the bearing sorting machine is a frame for 32 which is welded at 33 to spaced blocks 18 on each end of the sorting machine and includes extensions which extend to assist in positioning the drive mechanism. In each case, frame bar 32 is connected to one end of the floating bearings 25 or 27 by means of a connecting link 34. Connecting links 34 is connected to bar 32 and the bearing blocks by suitable bolt means which permits the bearing blocks to continue to move laterally, i.e. transversely of the longitudinal axes of the pulley shafts, upon bearing support rails 30. Drive frame bar 32 is rigid yet flexible enough to permit some lateral movement of the bearing blocks under stress. With one end of bearing blocks 25 and 27 being connected to drive frame bar 32, the position of the bearing blocks and the drive pulleys 22 will be adjusted whenever the gap between cylinders 12 is adjusted by means of set screws 38. Drive pulleys 22 are driven by belt 23.

Connecting the ends of cylinder supporting shaft 14 and pulley shafts 24 and 28, respectively is a flexible coupling 40 which, as seen in FIGS. 1 and 2, comprises a reinforced tubular member, such as a radiator hose, which transmits the drive from pulley shaft 24 or 28 to the cylinder supporting shafts 14 without transmitting radially extending forces that may be developed in the pulley shafts, by reasons of variations in the belt thickness or other reasons.

Figure 3:
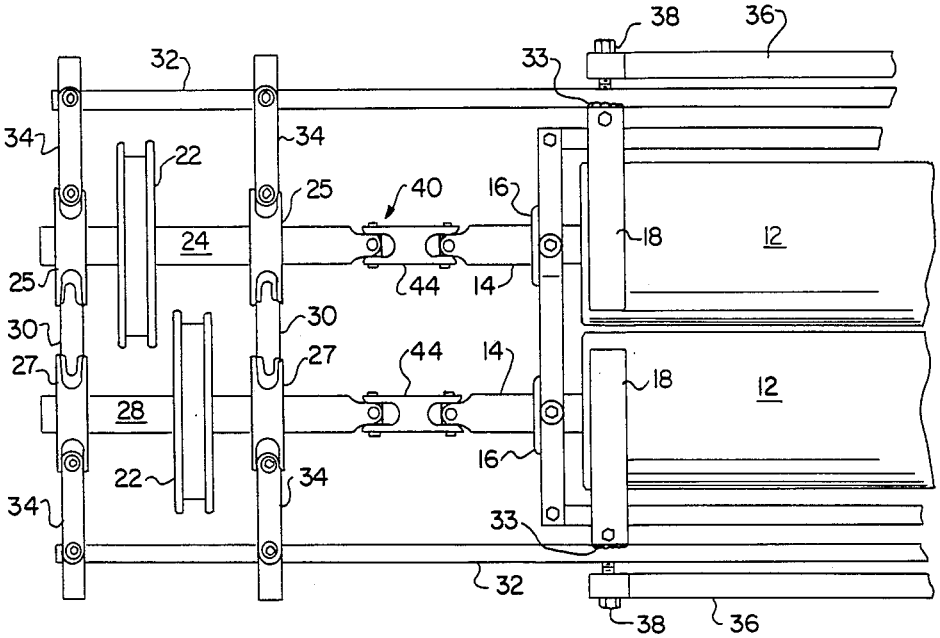
FIG. 3 is a top plan view, similar to that of FIG. 2, but showing a second embodiment of the drive mechanism for the sorting device.

Referring now to FIG. 3 wherein like parts carry the same reference characters as they did in the embodiment of FIG. 2. In this embodiment, the flexible tubular connection between the cylinder support shafts 14 and the pulley shafts 24 and 28 is replaced by a double universal joint 44. Each of the pulley shafts is connected to a cylinder supporting shaft by a link 44 which has a pivoted connection with the supporting shaft and with the pulley shaft. In this embodiment as in the embodiment of FIG. 2, the flexible coupling 40 transmits rotary motion from the pulley shaft to the supporting shaft for the cylinders without transmitting stress or torque in the pulley shaft to the supporting shaft 14.

Figure 4:
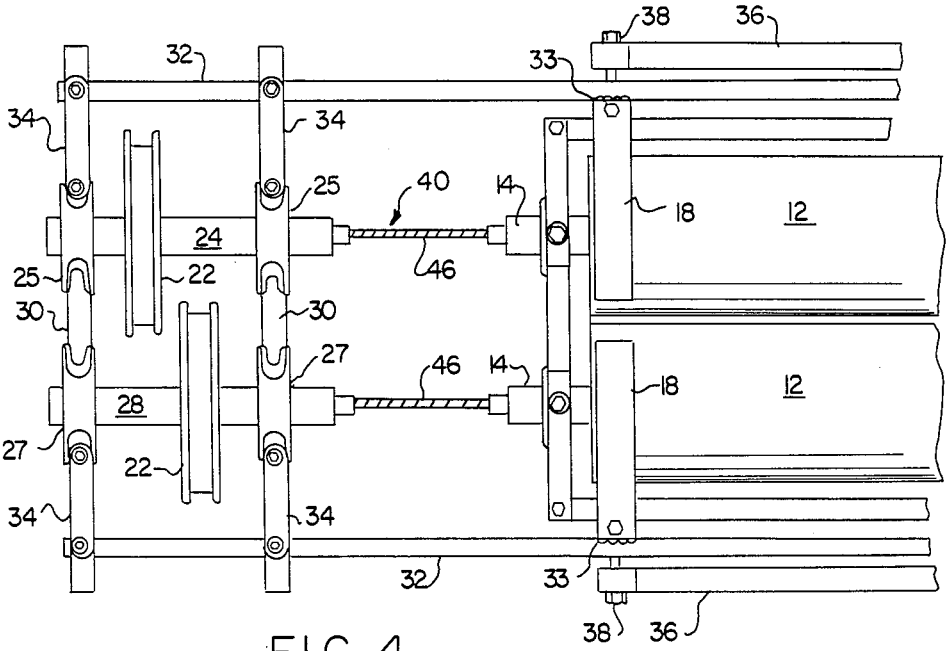
FIG. 4 is a top plan view, similar to that of FIG. 2, but showing a third embodiment of the drive for the sorting device of FIG. 1.

Referring now to FIG. 4 wherein the flexible coupling comprises a flexible cable such as those used in speedometers or the like. Cables 46 are connected by a suitable socket or tubular member to both supporting shafts 14 and the pulley shaft corresponding to said cylinder shaft. The flexibility of the cable permits the transmission of rotary motion to the support shaft 14 while permitting stresses to be absorbed by the bearing mounting of the pulley shafts.

Figure 6:
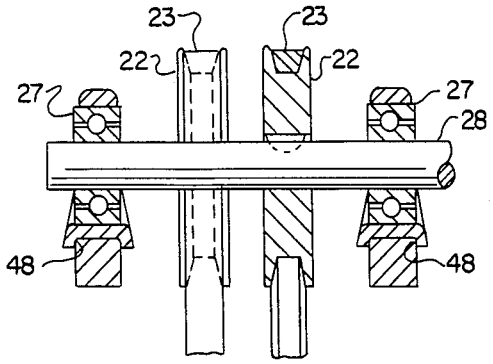
FIG. 6 is sectional view taken along lines 6—6 of FIG. 2 showing details of the support for the drive shaft.
Figure 5:
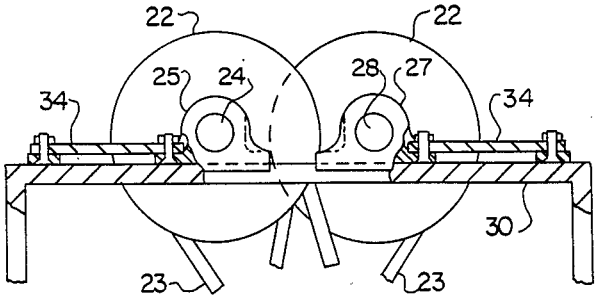
FIG. 5 is a sectional view taken along lines 5—5 of FIG. 2, illustrating the floating bearings supporting the drive pulleys.
Figure 7:
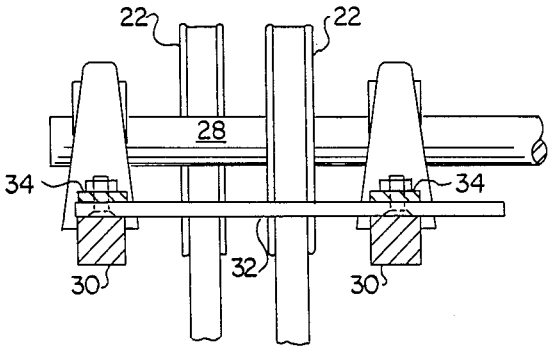
FIG. 7 is a sectional view taken along line 7—7 of FIG. 2.

Referring now more specifically to FIGS. 5, 6 and 7, wherein the support of bearing blocks 25 and 27 is shown in detail. Each of the bearing blocks comprises a base with a U-shaped groove 48. Groove 48 is slightly wider than rail 30 and sits upon rail 30 for sliding movement therealong, in a direction which is transverse of the longitudinal axes of the pulley shafts 24 and 28. Each of the bearing blocks 25 and 27 are mounted for movement independent of each of the other bearing blocks, that is, bearing blocks 25 may move in unison or independently of each other as can bearing blocks 22 and 27.

The operation of the bearing sorting device of FIG. 1 is the same whether it is equipped with the flexible coupling of FIGS. 2, 3 or 4. Drive pulleys 22 receive drive from a drive source, not shown, which rotates the pulley shafts 24 and 28 in opposite directions. Whenever a stress or strain is applied to the pulley shafts by its respective drive belt 23, such stress or strain will be absorbed by the floating bearing block 25 or 27, as the case may be, which will slide along the bearing support rail 30 without affecting the alignment of shafts 14 or sorting cylinders 12. With the flexible couplings shown in either FIGS. 2, 3 or 4, the sorting device shown in FIG. 1 will sort bearings to very high tolerances such as a tolerance of approximately five millionths of an inch.

One of the most important things about sorting bearings is that the value of the bearings are determined not necessarily by size but by the fact that all bearings in one group are within a certain tolerance spread. The closer the tolerance spread, the more valuable the group of bearings contained in that spread become, assuming that they are all made out of the same material. The accuracy of the bearing sorting is usually determined by measuring samples of the bearings electronically. It has been found that the sorting device using the flexible coupling drive of the invention has greatly reduced the spread within each range and therefor greatly increased the value of the bearings it sorts.

While a preferred embodiment of the invention has been described using specific terms, such description is for illustrative purposes only, and it is to be understood that changes and variations may be made without departing from the scope or spirit of the following claims.

What is claimed is:

1. An apparatus for sorting round bearings according to their diameter, comprising:

(a) a pair of elongated cylinders, each of which is fixed to a support shaft which is floatingly mounted for rotation in a spaced pair of support shaft bearing blocks so that the longitudinal axes of said elongated cylinders diverge, thereby creating a sorting gap between the surfaces of said cylinders which increases from one end of said cylinders to the other end;

(b) a pair of driven shafts, each of which is supported for rotation in two spaced driven shaft bearing blocks;

(c) driven means affixed to each of said driven shafts between said driven shaft bearing blocks;

(d) means supporting said driven shaft bearing blocks, for movement transversely of the longitudinal axes of said driven shafts;

(e) means for driving said driven means to rotate said driven shafts in opposite directions; and (f) flexible coupling means connecting each of said cylinder support shafts to a respective one of said driven shafts, whereby said elongated cylinders are rotated in opposite directions effectively eliminating fluctuating radial stresses present in the driven shafts from being transmitted to the support shafts of the elongated cylinders.

2. An apparatus for sorting round bearings as set forth in claim 1, wherein said means supporting said driven shaft bearing blocks comprises rigid guide rails which extend transversely of the longitudinal axes of said driven shafts and on which said bearing blocks are supported for sliding movement.

3. An apparatus for sorting round bearings as set forth in claim 1, wherein said flexible coupling means comprises a universal joint connecting said support shaft to said driven shafts.

4. An apparatus for sorting round bearings as set forth in claim 1, wherein said flexible coupling comprises a flexible cable which connects said support shafts to said driven shafts.

5. An apparatus for sorting round bearings as set forth in claim 1, wherein said flexible coupling comprises a reinforced flexible sleeve connected to said driven shafts and to said support shafts.

6. An apparatus for sorting round bearings as set forth in claim 1, wherein said driven means comprises pulleys affixed to said driven shafts.

7. An apparatus for sorting round bearings as set forth in claim 1, wherein each of said bearing blocks is connected to a flexible guide bar.

8. An apparatus for sorting round bearings as set forth in claim 1, wherein said bearing blocks for said driven shafts and the bearing blocks for supporting said elongated cylinders are connected to a flexible guide bar.

9. An apparatus for sorting round bearings according to their diameters, comprising:

(a) a pair of spaced elongated cylinders;

(b) means for rotatably and floatingly supporting said cylinders so that the longitudinal axes thereof diverge and the space between the surfaces of said cylinders increases from one end to the other, forming a sorting gap;

(c) means for supporting said cylinders on an incline, with said cylinders sloping downwardly from said one end to said other end;

(d) a driven shaft, supported for rotation in a pair of spaced bearing blocks, on a longitudinal axis which generally corresponds to the longitudinal axis of one of said cylinders, but spaced therefrom;

(e) driven means affixed to said shaft between said driven shaft bearing blocks;

(f) means supporting said driven shaft bearing blocks, for movement transversely of the longitudinal axis of said driven shaft;

(g) flexible coupling means connecting one of said cylinders to said driven shaft, whereby said cylinder is driven in one direction; and (h) means for driving said other elongated cylinder in a direction opposite to the direction said one cylinder is driven.

10. An apparatus for sorting round bearings as set forth in claim 9, wherein said drive means for said other cylinder comprises a flexible coupling.

11. An apparatus for sorting round bearings as set forth in claim 9, wherein said drive means for said other cylinder comprises a driven shaft supported in spaced bearing blocks.

12. An apparatus for sorting round bearings as set forth in claim 9, wherein said means supporting said driven shaft bearing blocks comprises rigid guide rails which extend transversely of the longitudinal axes of said driven shafts and on which said bearing blocks are supported for sliding movement.

13. An apparatus for sorting round bearings as set forth in claim 9, wherein said flexible coupling means comprises a universal joint connecting said support shaft to said driven shafts.

14. An apparatus for sorting round bearings as set forth in claim 9, wherein said flexible coupling comprises a flexible cable which connects said support shafts to said driven shafts.

15. An apparatus for sorting round bearings as set forth in claim 9, wherein said flexible coupling comprises a reinforced flexible sleeve connected to said driven shafts and to said supports shafts.

16. An apparatus for sorting round bearings as set forth in claim 9, wherein said driven means comprises pulleys affixed to said driven shafts.

17. An apparatus for sorting round bearings as set forth in claim 9, wherein each of said bearing blocks is connected to a flexible guide bar.

18. An apparatus for sorting round bearings as set forth in claim 9, wherein said bearing blocks for said driven shafts and the bearing blocks for supporting said elongated cylinders are connected to a flexible guide bar.

19. An apparatus for sorting round bearings according to their diameter, comprising:

(a) a pair of elongated cylinders, each of which has a smooth surface and is fixed to a rotatable shaft for rotation therewith so that the longitudinal axis of said elongated cylinders diverge, thereby creating a sorting gap between the surfaces of said cylinders which increases from one end of said cylinders to the other end;

(b) means for supporting said rotatable shafts so that the longitudinal axis of said cylinders both lie in a single inclined plane so that the surfaces of said cylinders slope downwardly from one end to the other end;

(c) drive means comprising a pair of driven shafts, each of which is supported in spaced bearing blocks adjacent to one end of said cylinders in a plane which intersects said inclined plane of said cylinders and means for driving said driven shafts in opposite directions; and (d) flexible coupling means for connecting each of said rotatable shafts to a respective one of said driven shafts to prevent stresses present in said driven shafts from being transmitted to said rotatable shafts.

20. An apparatus for sorting round bearings as set forth in claim 19, wherein said flexible coupling comprises a universal joint between said rotatable shafts and said drive means.

* * * * *